US006146215A

United States Patent [19]

Matsushita et al.

[11] Patent Number: 6,146,215

[45] Date of Patent: Nov. 14, 2000

[54] TERMINAL FITTING AND WATERPROOF CONNECTOR

[75] Inventors: Yasuo Matsushita; Mitsuhiro Fujitani, both of Yokkaichi, Japan

[73] Assignee: Sumitomo Wiring Systems, Ltd., Japan

[21] Appl. No.: 09/198,342

[22] Filed: Nov. 24, 1998

[30] Foreign Application Priority Data

Nov. 25, 1997 [JP] Japan ..... 9-323521
Jun. 17, 1998 [JP] Japan ..... 10-169878

[51] Int. Cl.[7] ..... H01R 13/40

[52] U.S. Cl. ..... 439/752.5; 439/752

[58] Field of Search ..... 439/752.5, 752, 439/595

[56] References Cited

U.S. PATENT DOCUMENTS 5,078,618 1/1992 Peloza ..... 439/843
5,470,258 11/1995 Suzuki et al. ..... 439/595
5,478,263 12/1995 Kato ..... 439/752
5,697,814 12/1997 Delaunay ..... 439/752

FOREIGN PATENT DOCUMENTS 0 677 891 4/1994 European Pat. Off. .
3-106676 11/1991 Japan .
5-11345 2/1993 Japan .
9-167651 6/1997 Japan .

OTHER PUBLICATIONS

Patent Abstract of Japan, vol. 97, No. 3, Mar. 31, 1997 & JP 8 298157, Nov. 12, 1996.

*Primary Examiner*—Gary F. Paumen
*Attorney, Agent, or Firm*—Banner & Witcoff, Ltd.

[57] ABSTRACT

Electrically conductive sheet metal is bent to form a terminal fitting 1. A pair of stabilizers or fins 6 protrude, and almost the entire face of the side faces of the stabilizers 6 is formed by a drawing process, the circumference edges thus being rounded, and forming bent areas 6B and 6C. As a result, even if the terminal fitting 1 is pulled out of a terminal housing chamber, the wall faces of the terminal housing chamber are not damaged by sharp edges, as is the case with a flat prior art stabilizer. Several embodiments are disclosed.

6 Claims, 7 Drawing Sheets

TERMINAL FITTING AND WATERPROOF CONNECTOR

TECHNICAL FIELD

The present invention relates to an electrical terminal fitting and a waterproof connector.

BACKGROUND TO THE INVENTION

FIGS. 12 to 16 show a waterproof connector 100 of the kind described in JP 8-298157. This waterproof connector 100 has terminal fittings 103 to which electric wires W are connected, and a connector housing 102 provided with terminal housing chambers 101 for housing the terminal fittings 103.

A waterproof stopper 104 is attached to the posterior portion of each terminal fitting 103 together with the electric wire W, this waterproof stopper 104 being inserted on and attached together with the electric wire W. When the terminal fittings 103 are attached to the terminal housing chambers 101, the waterproof stoppers 104 fit tightly between the electric wire W and the interior wall faces of the terminal housing chambers 101, and waterproof the rear face portion of the terminal housing chambers 101.

Further, as shown in FIGS. 13 and 14, stabilizers 105 protrude from the area close to the centre of each terminal fitting 103, these stabilizers 105 also preventing the terminal fittings 103 from being inserted incorrectly. As the terminal fittings 103 are housed in the terminal housing chambers 101, the stabilizers 105 make contact with interior wall faces 106 of the terminal housing chambers 101 (also see FIG. 15).

If the terminal fittings 103 are formed by being punched from a metal plate, edge portions of the stabilizers may have sharp edges.

It is possible that terminal fittings 103 are not required in a certain number of terminal housing chambers 101, depending on the type of connector housing 102. In such a case, the attachment operation of the terminal fittings 103 may be completed with the terminal fittings 103 being inserted in the wrong sites, and with the electric wires W protruding from the connector housing 102 being covered in the usual plastic tape. When the connector housing 102 is later checked, it will be noticed that some terminal fittings 103 are in the wrong sites, and the terminal fittings 103 must be pulled out of the terminal housing chambers 101 and re-inserted in the correct sites. At this juncture, since the electric wires W are covered in plastic tape, it is difficult to pull the terminal fittings 103 out and it is sometimes necessary while pulling out the stabilizers 105 to press them against the interior wall faces 106 of the terminal housing chambers 101. If the anterior edges 105A of the stabilizers 105 are sharp, they sometimes damage the interior wall faces 106, forming grooves 107 (FIG. 16).

The formation of this type of groove 107 would reduce the waterproofing properties of the connector.

The present invention has been developed after taking the above problem into consideration, and aims to present terminal fittings which do not damage the interior wall faces of the terminal housing chambers when these terminal fittings are to be pulled out from the connector housing to which they are attached and also aims to present a waterproof connection using this type of terminal fittings.

SUMMARY OF THE INVENTION

According to the invention there is provided a metal terminal fitting for insertion in a chamber of a connector housing, the terminal fitting having at least one projection adapted to prevent upside-down insertion of the fitting into a chamber, characterised in that the chamber-engaging portion of said projection is blunt. The fitting may be in the form of a fin, or may be pressed or part-sheared out of a wall of the terminal. Preferably the chamber-engaging portion is smoothed by being formed as a bent-over edge or with a tapering or radiused profile. In a preferred embodiment the chamber engaging-portion comprises the drawn edge of a fin, this presenting a smoothed edge around the entire periphery thereof.

BRIEF DESCRIPTION OF DRAWINGS

Other features of the invention will be apparent from the following description of preferred embodiments shown by way of example only in the accompanying drawings, in which.

DESCRIPTION OF PREFERRED EMBODIMENTS

Figure 1:
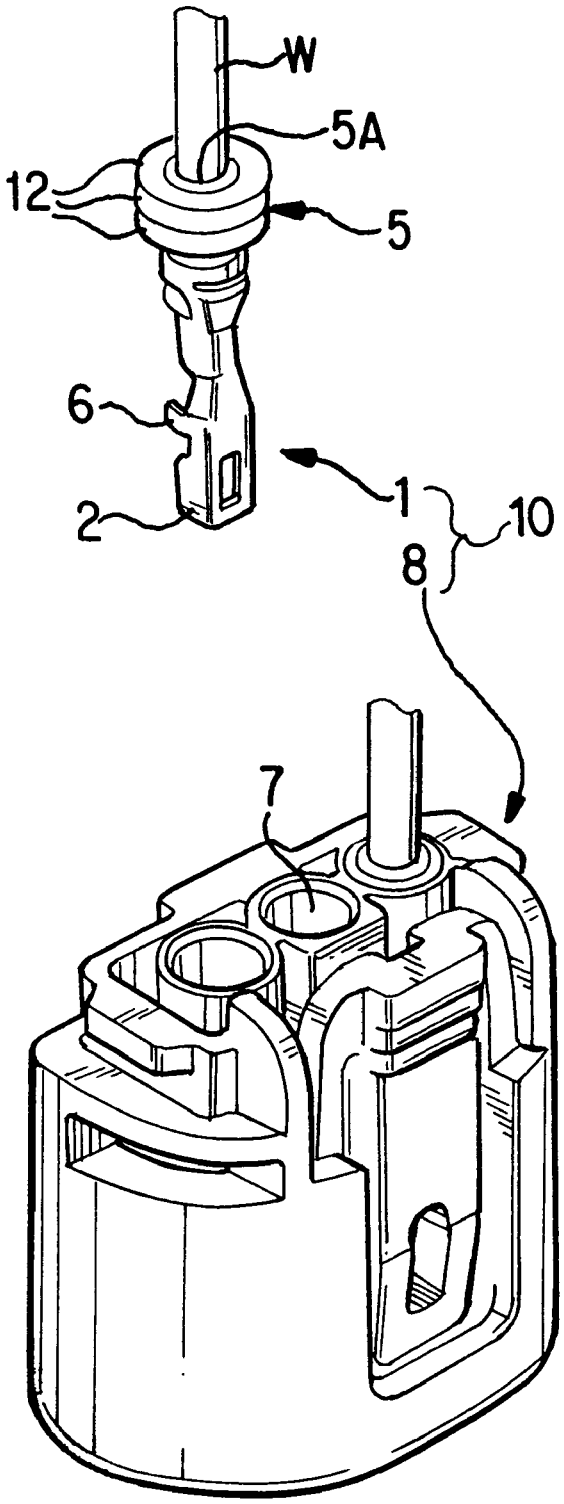
FIG. 1 is a diagonal view of a first embodiment showing a connector housing and a terminal fitting prior to being attached.

FIG. 1 shows a waterproof connector 10 of a first embodiment in a state prior to attachment. This waterproof connector 10 is provided with terminal fittings 1 and a connector housing 8 which houses the terminal fittings 1.

Figure 2:
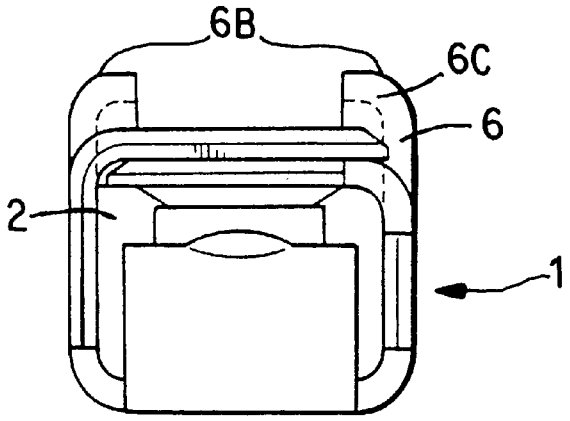
FIG. 2 is a front elevation of the terminal fitting of FIG. 1.

The connector housing 8 is formed in a unified manner from synthetic resin, the interior thereof housing the terminal fittings 1. The posterior face of the connector housing 8 (the anterior face being that face of the waterproof connector 10 which fits with a corresponding connector (not shown)) is provided with terminal housing chambers 7, three aligned terminal housing chambers being illustrated. The terminal fittings 1 are inserted into the terminal housing chambers 7, electric wires W being attached to the terminal fittings 1. A bendable lance 11 protrudes from the upper wall face of each terminal housing chamber 7 from a location slightly anterior to the central portion thereof (also see FIG. 2). These lances 11 engage the terminal fittings 1 and retain them inside the terminal housing chambers 7. Further, a terminal insertion hole 7B opens out on the anterior end of each terminal housing chamber 7 in order to allow tabs of male terminal fittings (not shown) to be inserted.

A removal hole 11A formed when the resin is moulded opens out on the anterior face of the connector housing 8. The lance 11 and the terminal fitting 1 can be separated by inserting a jig (not shown) via this removal hole 11A and moving the lance 11 in a releasing direction.

Figure 3:
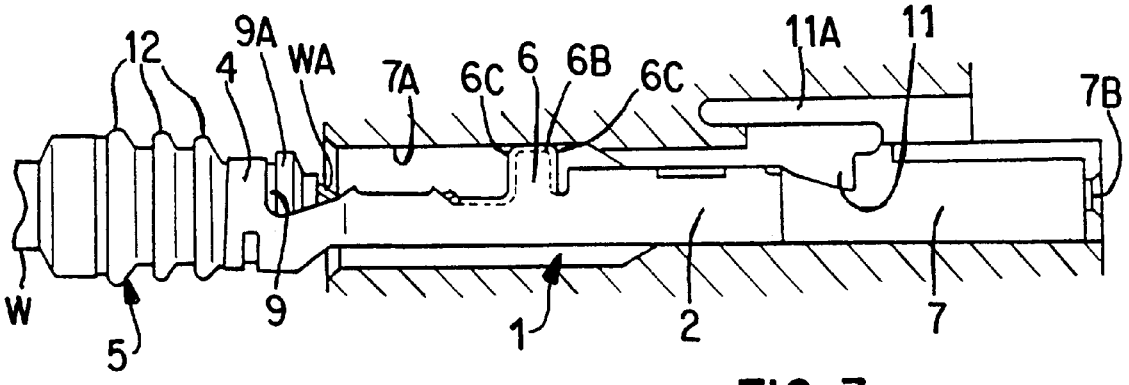
FIG. 3 is a cross-sectional side view showing the terminal fitting of FIG. 1 housed within a connector housing.

FIG. 3 shows a female terminal fitting 1 formed by being punched out in a specified shape from electrically conductive sheet metal and then being bent. The anterior portion of the terminal fitting 1 forms a box-shaped joining member 2, a male terminal fitting (not shown) being inserted into this joining member 2 from the tip thereof. Further, pairs of barrels 3 and 4 protrude from the posterior portion of the terminal fitting 1. Of these two barrels, the pair located toward the anterior is a wire barrel 3 which crimps a core wire portion of the electric wire W, and the pair located toward the posterior is an insulation barrel 4 which crimps a covered portion of the electric wire W and a waterproofing member 5. Compared to the wire barrel 3, the insulation barrel 4 is narrower in width in an anterior-posterior direction, and protrudes further. The barrels 3 and 4 are brought together from the right and left so as to tightly surround the electric wire W or the waterproofing member 5 and thereby form a unitary body.

Figure 4:
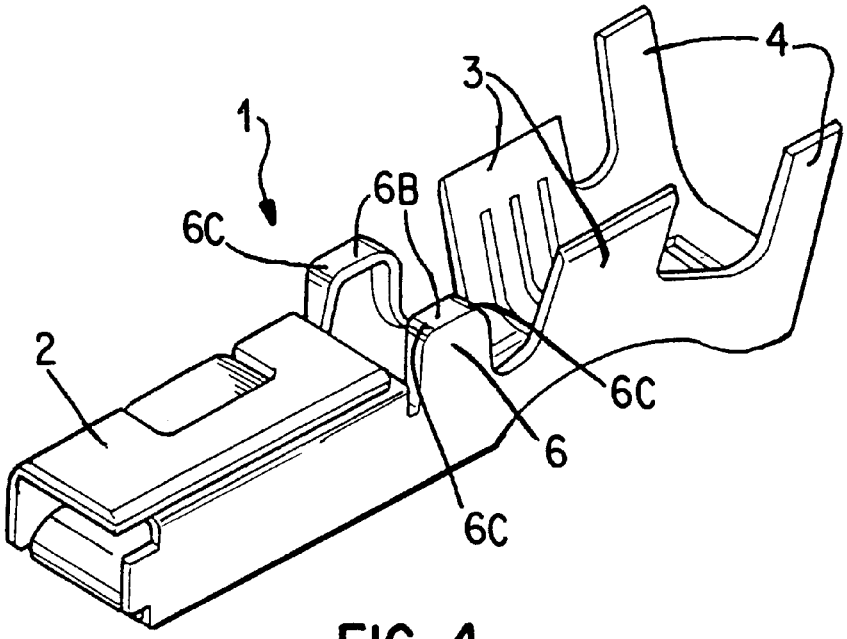
FIG. 4 is a diagonal view of the terminal fitting of FIG. 1.

A pair of stabilizers or fins 6 protrude from the left and right between the joining member 2 and the wire barrel 3. These stabilizers 6 prevent the terminal fitting 1 from being inserted upside down when the terminal fitting 1 is to be attached to the terminal housing chamber 7 of the connector housing 8. When the terminal fitting 1 is punched out, the stabilizers 6 are formed out into a flat trapezoid shape and then almost the entire face, with the exception of the portion along the circumference of the side faces, is formed by a drawing process. Drawing causes the edge portions of the stabilizer 6 (the upper edge and the portions anterior and posterior to the upper edge) to be brought mutually together toward the interior of the terminal fitting 1. Further, the upper edge of the stabilizer 6 assumes a rounded shape extending from the side faces to the inner edges, this constituting a bent face 6B, and the anterior and posterior corners of the upper edge of the stabilizer 6 assume a rounded shape in an anterior-posterior direction, these constituting bent faces 6C. When the terminal fitting 1 is inserted in the terminal housing chamber 7, the upper part of the bent faces 6B make contact with interior wall faces 7A. Moreover, if the stabilizers 6 are viewed from the anterior face of the terminal fitting 1, only that portion of the stabilizers 6 which has been formed by a drawing process has a greater cross-sectional area than the prior art example (see FIG. 4). That is, flat stabilizers 105 of the conventional type cut forcibly into the end faces of the connector housing 102, and therefore the terminals may be inserted upside down. However, the stabilizers 6 of the present embodiment have a substantially greater width. As a result it is extremely difficult for them to cut grooves, this also preventing them from being inserted upside down in an effective manner.

The waterproofing member 5 is made from resilient synthetic rubber, the centre therefore being provided with a wire through hole 5A which allows the electric wire W to be inserted therethrough. The anterior portion of the waterproofing member 5 is provided with a tubular attachment member 9 which is crimped by the insulation barrel 4 of the terminal fitting 1. The anterior end portion of the attachment member 9 has a slightly greater diameter than the posterior portion, and constitutes a stopping member 9A. The posterior of the attachment member 9 is provided with three ribbed waterproofing components 12, these fitting tightly with the cover of the electric wire W and the interior wall face 7A of the terminal housing chamber 7, thereby waterproofing the terminal housing chamber 7.

With the configuration as described above, the operation and effects of the present embodiment are described hereinbelow.

The terminal fitting 1, to which the electric wire W and the waterproofing member 5 have been attached, is inserted into the terminal housing chamber 7 from the posterior face of the connector housing 8. When the terminal fitting 1 is pushed in up to a specified position, the lance 11 returns from a bent position, engaging and retaining the terminal fitting 1 is a stopped state. At this point, the waterproofing member 5 is pushed tightly against the electric wire W and the interior wall face 7A and waterproofs the terminal housing chamber 7.

Next the operation is explained of how the terminal fitting 1 is removed from the connector housing 8 after the terminal fitting 1 has been attached to the terminal housing chamber 7.

First, a jig is inserted via the removal hole 11A which opens onto the anterior face of the connector housing 8, and the lance 11 is bent upwards. In this manner, the fitting of the terminal fitting 1 and the lance 11 is released. Meanwhile, the electric wire W or the waterproofing member 5, both of which are attached to the terminal fitting 1, is grasped, the entire terminal fitting 1 is pulled in a posterior direction, and the terminal fitting 1 is pulled out of the terminal housing chamber 7. At this point, the bent faces 6B and 6C formed on the upper edges of the stabilizer 6 make contact with and slide along the interior wall faces 7A inside the terminal housing chamber 7. Since the bent faces 6B and 6C have been formed by a drawing process, they do not have edges against the chamber walls. Therefore, unlike the conventional model, they do not damage the interior wall faces 7A of the terminal housing chamber 7.

Further, since the bent faces 6B and 6C are formed by a drawing process, they can be formed without difficulty.

Moreover, almost the entire face of the side faces of the stabilizes 6 has been formed by a drawing process. Consequently, the portions along the circumference edge acquire a shape which provides the same effect as if the plate thickness of the stablisers 6 had been increased. As a result, in the case in which a terminal fitting 1 is inserted upside down, the edges of the stabilizers 6 strike against that portion of the wall face of the connector housing which as a recess and, since the thickness of the edge portions have been increased, these edge portions do not cut into the wall faces.

Figure 5:
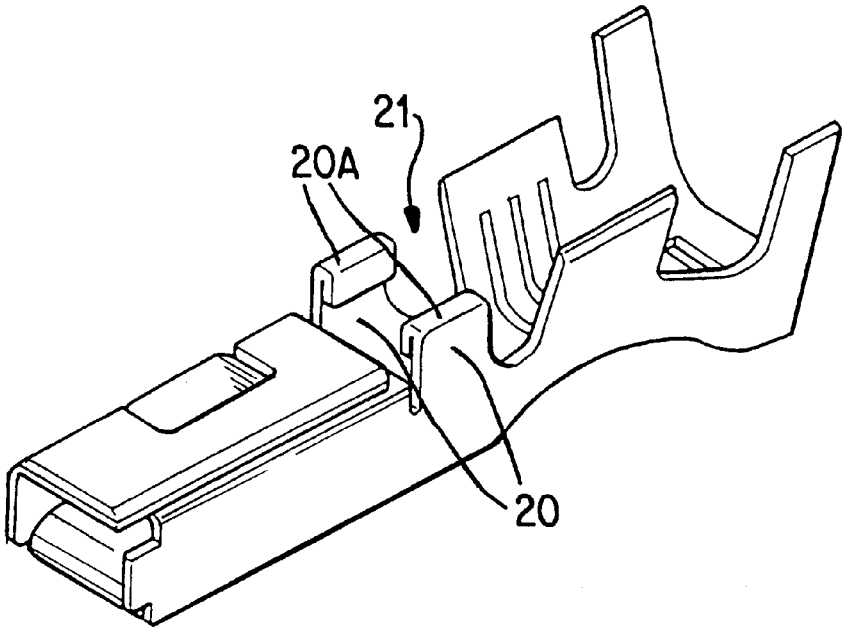
FIG. 5 is a partial diagonal view of a second embodiment of a terminal fitting.

A second embodiment of the present invention will be explained with the aid of FIG. 5. An explanation is omitted of those portions of the present embodiment having the same configuration as the first embodiment, and these are accorded the same numbers.

A pair of stabilizers 20 protrude from the left and right sides of a terminal fitting 21, close to the central portion thereof, the ends of these stabilizers 20 mutually facing one another and being bent over inwards. These constitute bent faces 20A, these bent faces 20A being formed from electrically conductive sheet metal bent over to form a double thickness, and extending from the side faces to the upper faces of the stabilizers 20.

This configuration has the same operations and effects as the first embodiment.

Figure 6:
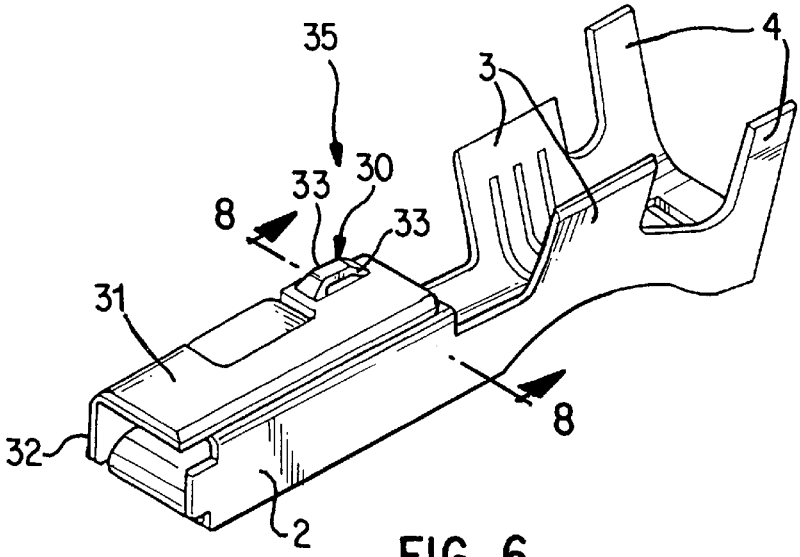
FIG. 6 is a diagonal view of the terminal fitting according to a third embodiment.
Figure 7:
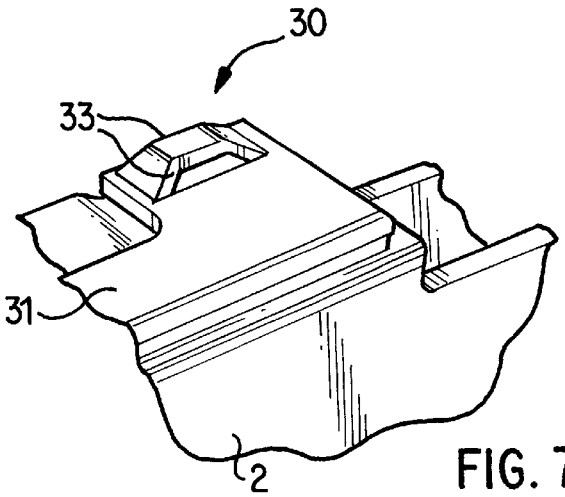
FIG. 7 is an enlarged view of part of FIG. 6.
Figure 8:
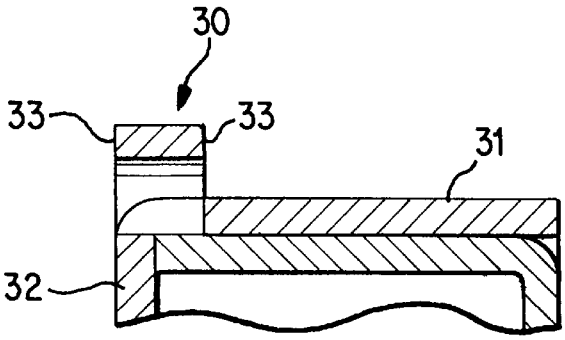
FIG. 8 is a cross-section on line 8–8 of FIG. 6.

A third embodiment is shown in FIGS. 6, 7 and 8. A stabiliser 30 formed on a terminal fitting 35 differs from the one in the first embodiment in that it has been formed by part shearing out of the sheet metal.

A joining member 2 of the terminal fitting 35 is formed by bending into an angular shape and making the metal sheet overlap along one face. The stabiliser 30 of the present embodiment is located towards the posterior end (towards the barrel 3) on the exterior of this overlapping portion.

Before, for example, the metal sheet is bent into an upper face area 31 and a side face area 32 of the joining member 2, a portion of the border (the bending line) between the areas 31 and 32 and a portion of the upper face area 31 are provided with mutually parallel cuts 33, these being pressed outwards, thereby resulting in the stabiliser 30 forming a bridge shape that extends in the terminal insertion direction. Further, in the stabiliser 30, the anterior and posterior ends with respect to the direction of fitting into the connector of the terminal fitting 35 rise gently in a tapered manner from the terminal surface. After the stabiliser 30 has been formed, the metal plate is bent into the shape of the terminal fitting 35.

Apart from the configuration of the stabiliser 30, the terminal fitting 35 of the present embodiment is identical with that of the first embodiment and accordingly an explanation is omitted of those portions of the present embodiment having the same configuration as the first embodiment, and these are accorded the same numbers.

The waterproof connector (not shown) having the terminal fitting 35 housed therein has a groove provided in the terminal housing chamber that corresponds to the stabiliser 30.

In the terminal fitting 35 of the third embodiment, the ends with respect to the direction of fitting into the connector of the terminal fitting 35 rise gently in a tapered manner from the upper face area 32. As a result, as in the case of the previous embodiment, there is no possibility of damage occurring to the wall faces of the terminal housing chamber, as happens in the conventional case when the terminal fitting 35 is pulled out from the terminal housing chamber of the connector.

Figure 9:
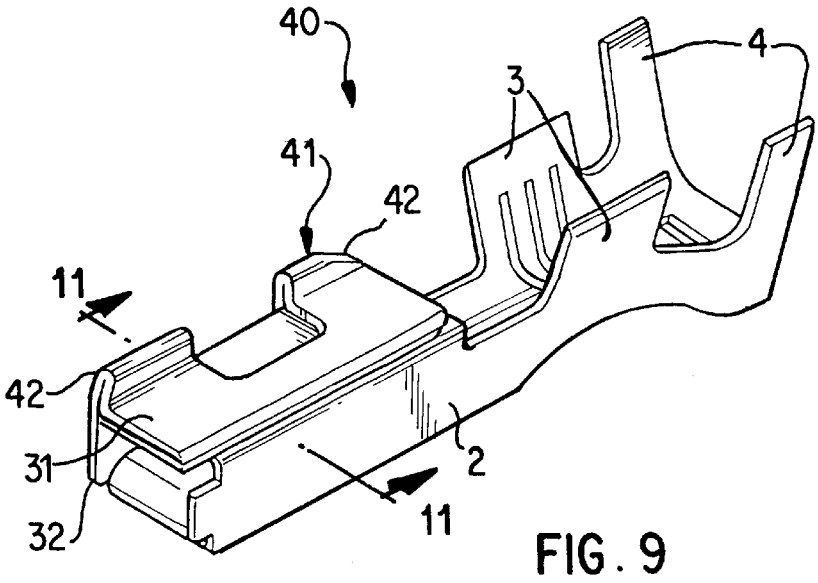
FIG. 9 is a diagonal view of a fourth embodiment.
Figure 10:
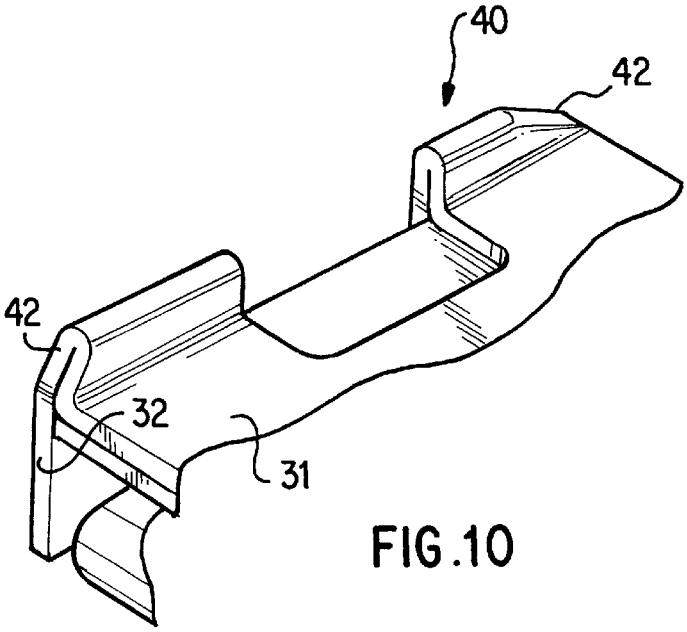
FIG. 10 is an enlarged view of part of FIG. 8.
Figure 11:
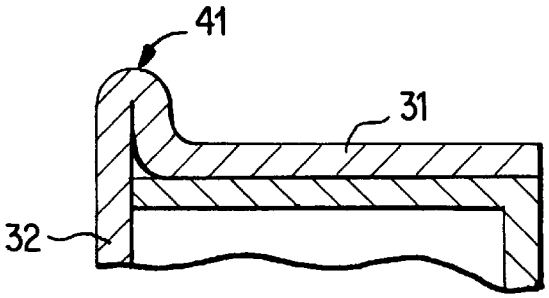
FIG. 11 is a cross-section on line 11–11 of FIG. 9.
Figure 12:
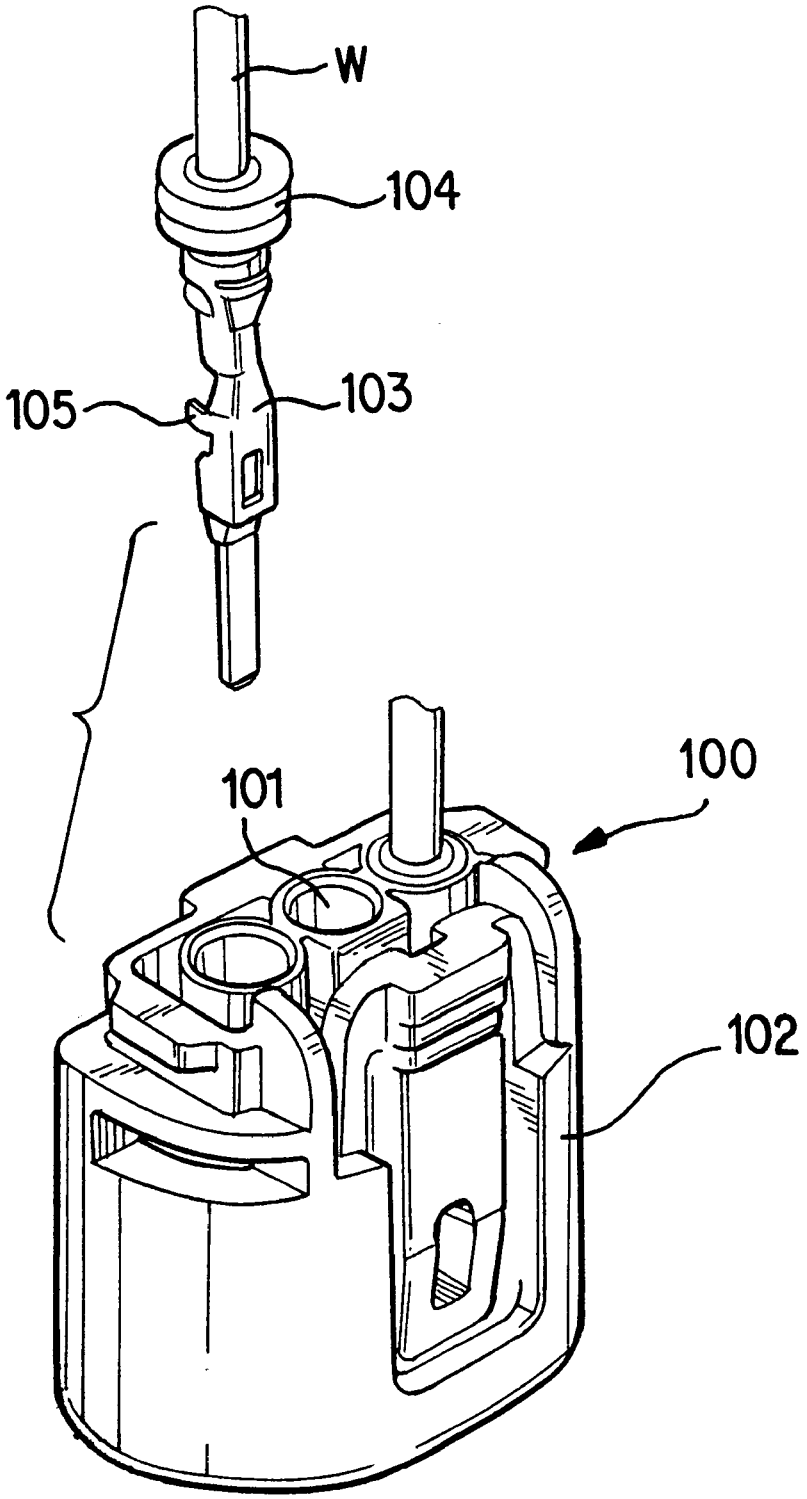
FIG. 12 PRIOR ART
FIG. 12 is a diagonal view showing a prior art connector housing and a terminal fitting prior to being attached.
Figure 13:
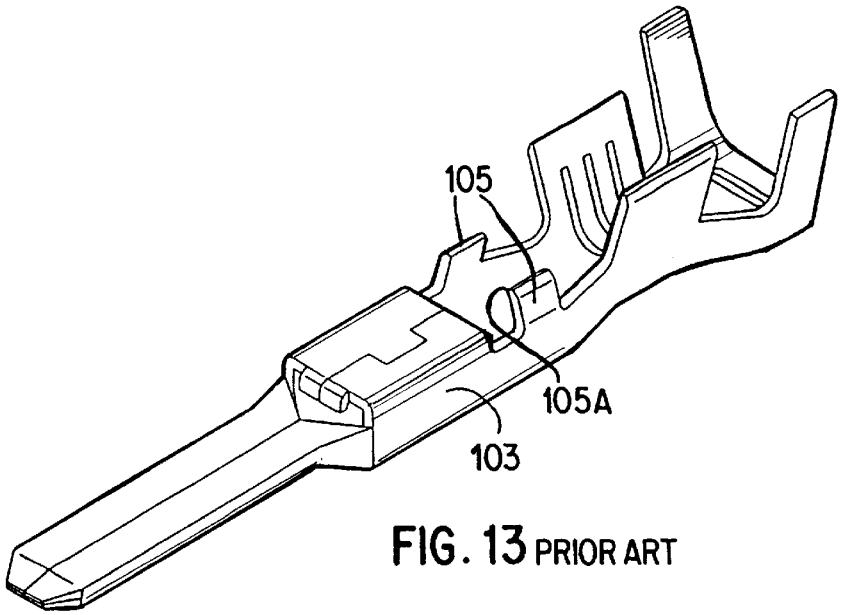
FIG. 13 PRIOR ART
FIG. 13 is a diagonal view of the terminal fitting of the prior art example.
Figure 14:
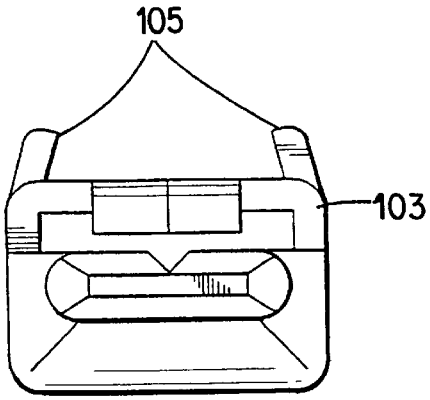
FIG. 14 PRIOR ART
FIG. 14 is a front view of the terminal fitting of the prior art example.
Figure 16:
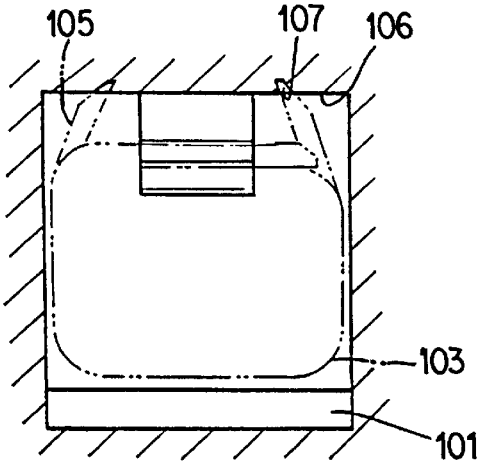
FIG. 16 PRIOR ART
FIG. 16 is a rear cross-sectional view of the prior art example showing interior face walls of the terminal housing chamber after a terminal fitting housed therein has been removed.
Figure 15:
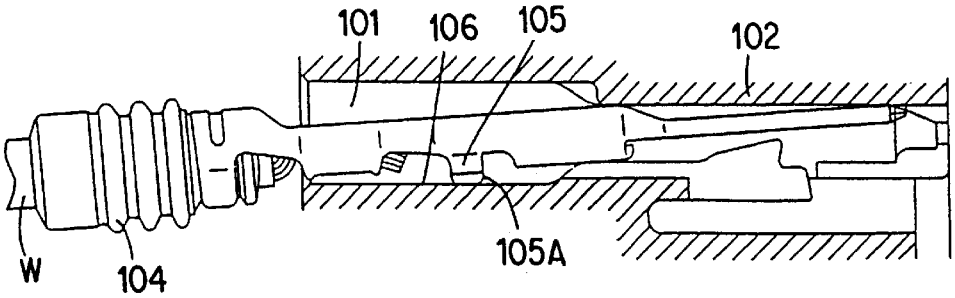
FIG. 15 PRIOR ART
FIG. 15 is a cross-sectional view of the prior art example showing the terminal fitting housed with a connector housing.

A stabiliser 41 of a fitting 40 according to a fourth embodiment is shown in FIGS. 9, 10 and 11. The stabiliser 41 is formed in a rib shape by bending the metal sheet forming a joining member 2 into a right angle. Since the configuration of the present embodiment is basically identical with that of the third embodiment in all other respects, an explanation is omitted of those portions of the present embodiment having the same configuration as the third embodiment, and these are accorded the same numbers.

As shown in FIG. 10, the stabiliser 41 of the present embodiment is formed by tightly bending the upper end of the side face area 32 of the joining member 2, this being further bent at a right angle to form the upper face area 31. As shown in FIG. 9, by doing this, the stabiliser 41 comes to extend in a rib shape along the side of the joining member 2. Further, the anterior and posterior ends of the stabiliser 41 have tapers 42 that extend gradually from the upper face area 31 to the terminal fitting 40.

In the terminal fitting 40 of the fourth embodiment, the stabiliser 41 is formed by tightly bending the metal sheet constituting the terminal fitting. Accordingly, the portion connecting to the terminal fitting is well supported and the stabiliser 41 is strengthened. Moreover, since tapers 42 are formed on the stabiliser 41 on the edges extending along the insertion direction of the stabiliser 41, as in the case of previous embodiments, there is no possibility of damage to the wall faces of the terminal housing chamber when the terminal fitting 40 is pulled out from the terminal housing chamber, as happens in the conventional case.

The present invention is not limited to the embodiments described above. For example, the possibilities described below also lie within the technical range of the present invention.

(1) The present embodiment shows only a female terminal fitting. However, the present invention applies equally to both male and female terminal fittings.

(2) If the rounded portion of the edge of the stabilizer is needed only for the time when the terminal fitting is pulled out, the rounded portion may be provided on the posterior portion only.

What is claimed is:

1. A metal terminal for insertion in a chamber of a connector housing, the terminal fitting including a joining member for connecting with a complementary terminal fitting, an attachment member for connecting with a wire, and at least one upstanding fin to prevent upside-down insertion of the fitting into a chamber of a housing, wherein the fin is a plate member with an upstanding portion and a bent-over portion extending transversely inward from the upstanding portion, said bent-over portion having a flat outer surface and a posterior edge which is blunt to engage the wall of the chamber and avoid cutting the chamber wall.

2. A fitting according to claim 1 wherein said projection is an upstanding fin, and wherein the chamber engaging portion comprises a bent-over edge.

3. A fitting according to claim 2 wherein said bent-over edge is formed by drawing.

4. A fitting according to claim 3 wherein said bent-over edge extends around the periphery of said projection.

5. A fitting according to claim 2 wherein said bent-over edge comprises a portion of said fin folded back on itself through 180°, a chamber engaging end of said fin being smoothly radiused.

6. A waterproof connector including a plurality of chambers having therein a respective terminal fitting according to claim 1.

* * * * *